United States Patent [19]

Beck et al.

[11] Patent Number: 4,698,466

[45] Date of Patent: Oct. 6, 1987

[54] AUTOMOTIVE SWITCH

[75] Inventors: Willi K. Beck, Hingham; Lincoln V. Danielson, Seekonk, both of Mass.

[73] Assignee: Joseph Pollak Corporation, Boston, Mass.

[21] Appl. No.: 904,489

[22] Filed: Sep. 8, 1986

[51] Int. Cl.[4] ..... H01H 3/16

[52] U.S. Cl. ..... 200/61.78; 200/61.82; 200/302.2

[58] Field of Search ..... 200/61.62, 61.78, 61.82, 200/159 R, 159 A, 340, 302.2

[56] References Cited

U.S. PATENT DOCUMENTS

| | | | |
|---|---|---|---|
| 2,921,155 | 1/1960 | Basso | 200/61.82 |
| 3,151,224 | 9/1964 | Colucci | 200/61.62 |
| 3,190,982 | 6/1965 | Woodcock | 200/159 R X |
| 3,244,829 | 4/1966 | Webb | 200/61.62 |
| 3,251,971 | 5/1966 | Fraser | 200/159 R |
| 3,300,755 | 1/1967 | Dunn | 340/52 R |
| 3,393,281 | 7/1968 | Basso | 200/61.62 |
| 3,710,048 | 1/1973 | Schumacher | 200/52 R |
| 3,766,342 | 10/1973 | Stadelmann | 200/61.89 |
| 4,263,488 | 4/1981 | Frietag et al. | 200/52 R |
| 4,406,935 | 9/1983 | Montag et al. | 200/61.82 |

*Primary Examiner*—A. D. Pellinen
*Assistant Examiner*—Morris Ginsburg
*Attorney, Agent, or Firm*—George W. Crowley

[57] ABSTRACT

A vehicular switch for activating and deactivating a circuit or circuits in response to movement of one vehicular component relative to another such as a door relative to a door frame. The switch is a compact miniaturized unit insertable in the fixed component and self-adjusting to accommodate variations in spacing between fixed and movable components. Seals are provided to block access of water or other destructive materials irrespective of the position of the movable vehicle component relative to the fixed component. All electrical elements are completely enclosed in a weather-tight package.

8 Claims, 2 Drawing Figures

AUTOMOTIVE SWITCH

This invention relates in general to circuit activating switches commonly used in automobiles, and in particular to such switches which perform various functions such as turning lights on and off in the vehicle.

BACKGROUND OF THE INVENTION

Switches for activating and deactivating circuits to perform various functions are commonly employed, especially in vehicles. One such switch which is frequently encountered is a so-called courtesy switch which derives its name from its usual function of turning on a light as an aid to the operator of the vehicle as he enters or exits the vehicle. Similar switches are often used to turn on a light when, for example, a trunk lid is lifted, an engine hood is lifted, or a glove compartment door is opened. Practically all such switches include an actuating plunger or lever which moves generally under spring pressure when the spacing is increased between fixed and movable members. Whether the movable member is a passenger door, a trunk lid, a hood, a tailgate, or a glove compartment door, the switches have one common problem. Mass-produced vehicles necessarily have some manufacturing tolerances in the dimensions of elements designed to fit relative to each other. As a result, a switch designed for such use as in the door post of a vehicle must be capable of operation in response to the opening and closing of doors which may be closely or loosely fitted relative to that door post.

Efforts have been made to accommodate the varying gaps which are encountered in a run of mass-produced vehicles. One expedient has been to permit overtravel as needed in the actuating member of the switch, but the excessive length of such switches leads to early failure. Other efforts have been made to give the switch a degree of self-adjustment using, for example, such items as telescoping sleeves in the switch body, but too often these have been ineffective or unduly expensive.

Another persistent problem relates to the environment in which the switches are used. Most of the switches with which the present invention is concerned are so positioned relative to the exterior of the vehicle that they are exposed to weather and environmental conditions which may reach extremes, depending upon the geographical area where the vehicle is used. Clearly, a door switch may be thoroughly soaked in a rain storm; ice or snow may enter and melting or freezing in the switch area interferes with the operation of the switch. Even dust or dirt may interfere with switch operation if it accumulates in critical areas.

SUMMARY OF THE INVENTION

It is the primary object of the present invention to provide reliable compact weather-resistant switches for automotive vehicles.

It is another object of the invention to reduce the cost and complexity of switches utilized in automotive vehicles.

It is a further object of the present invention to provide a self-adjusting courtesy switch which compensates for variations in manufacturing tolerances in automotive vehicles.

It is a still further object of the present invention to block the disabling effects of weather and environmental conditions on courtesy switches.

The present invention achieves the foregoing objects by incorporating in a vehicle switch a mount and an adjustable mounting system which permits the switch to assume the optimum position in a fixed vehicle component such as a door post for the particular tolerances involved in the vehicle in which the switch is installed. The switch also includes front and rear seals which resist the entry of water or foreign matter into areas where they might interfere with proper switch action. The seals are effective irrespective of the position of switch elements. All of the elements of the switch including electrical contacts and connections are incorporated in a cylindrical body of relatively small diameter which may be inserted conveniently in the fixed component of the vehicle.

Although, as noted, the invention may be utilized in numerous vehicular applications, for convenience only, it will be described in connection with a preferred embodiment, namely, a passenger door light-switching circuit described in detail below and shown in the appended drawing, in which:

FIG. 1 is a cross-sectional view taken through the axis of the switch of the invention showing the electrical contacts closed; and FIG. 2 is a view similar to that of FIG. 1, but the electrical contacts are open.

DESCRIPTION OF THE PREFERRED EMBODIMENT

Figure 1:
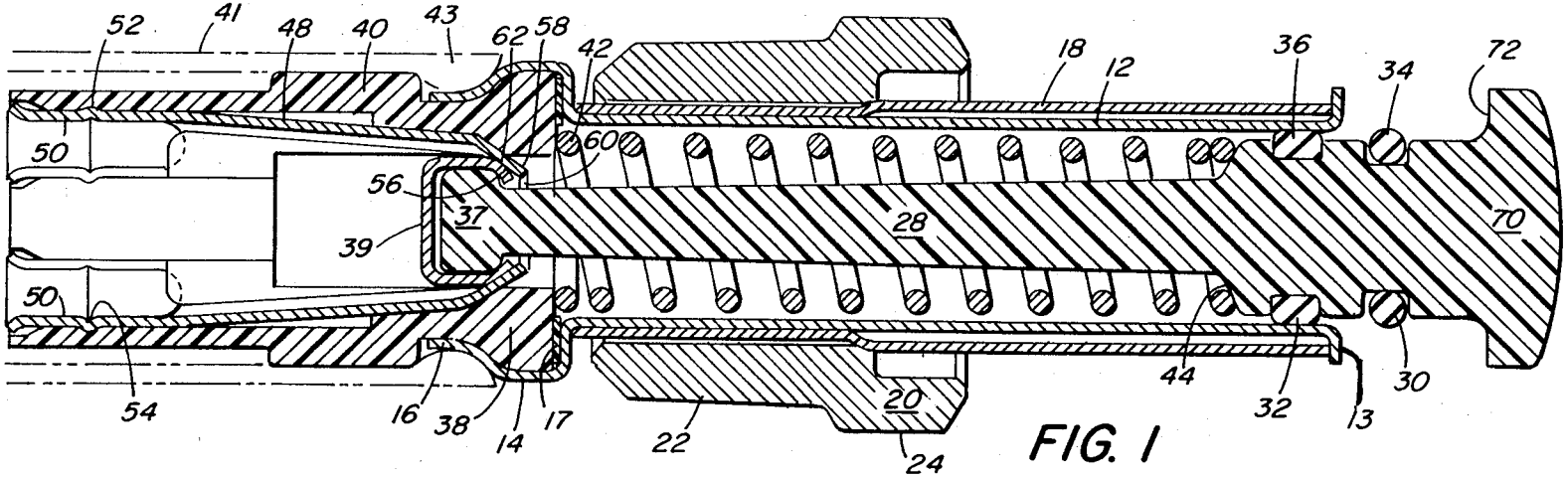

In FIG. 1, there may be seen a switch for installation in the door post of a vehicle having a sleeve assembly which includes a sleeve body 12. The sleeve body 12 may be made of any of several metal or plastic materials but, for convenience, it is preferably made of relatively thin-walled brass tubing. At its right-hand end as shown in the drawing, the sleeve 12 has a flange 13 which may be formed by any suitable technique such as turning at right angles. At its left-hand end, the sleeve 12 is formed first into a shoulder 14 and that shoulder is rolled inwardly adjacent the extremity 16. A washer 17 of resilient material such as silicone rubber is fitted under the shoulder 14. Retained between the flange 13 and the outside of the shoulder 14 is a mounting sleeve 18 also preferbly made of relatively thin brass tubing and having a shoulder dividing it into portions of large and small diameter. The mounting sleeve 18 may be fluted along the length of the larger diameter to increase its strength and provide frictional engagement with a mounting member such as the nut 20 made of hardened material. The mounting member may be a threaded nut, as shown, a snap-in mount or other suitable holder made of case-hardened cold-drawn steel preferably plated with zinc or other rust-resistant material.

The mounting nut 20 has a smooth interior surface and has external threads on its outer surface 22 by which it may be installed in a door post or pillar. A peripheral area of the outer surface 24 adjacent its end is formed into hexagonal flats to accommodate a wrench. Within the sleeve body 12 a plunger 28 is disposed for reciprocation. The plunger 28 is provided with annular recesses 30 and 32 adjacent its right-hand end and O-rings 34 and 36 are disposed in those annular recesses. For reasons explained below, the recess 30 is somewhat deeper than the recess 32.

The plunger 28 may be tapered as shown along its length and at its opposite smaller-diameter end an enlargement 37 is formed. The entire plunger is preferably molded from durable insulating material such as glassfilled nylon. Loosely fitted about and surrounding the enlargement 37 is a floating contact 39 made of copper or other conductive material.

The previously noted mounting sleeve extremity 16 is rolled over to tightly engage the washer 17 and an enlarged end 38 of a base 40. A rubber boot 41 having a ringed end 43 resiliently engaging the extremity 16 of the sleeve 12 extends backwardly (to the left as shown) to cover the base 40. A compression spring 42 is disposed between the enlarged end 38 of the base 40 and a shoulder 44 formed on the plunger 28 and normlly urges the plunger 28 toward the right as shown.

The base 40 is also molded from durable insulating material such as nylon and has three equiangularly spaced openings formed parallel to its axis. Three tapered generally cylindrical terminal contacts 48 are disposed within the openings formed in the base 40. Each terminal contact 48 has a split cylindrical connector jack as at 50. These jacks are made of electrically conductive material such as copper and include rounded ring enlargements 52 which are resiliently engaged by matching ring depressions 54 formed in the walls of the openings formed in the base 40. Extending from the inner ends of the jacks 50 are arcuate contact members 56 which are deflected inwardly by a tapered area 58 formed in the base 40. All three extension contact members 56 are symmetrically deflected together so as to form a substantially circular opening 60 through which the small end of the tapered plunger 28 passes. The outer surface 62 of the floating contact 39 is so configured that it matches substantially the inner fixed contact surface formed by the mutually inwardly deflected fixed contacts 56.

Figure 2:
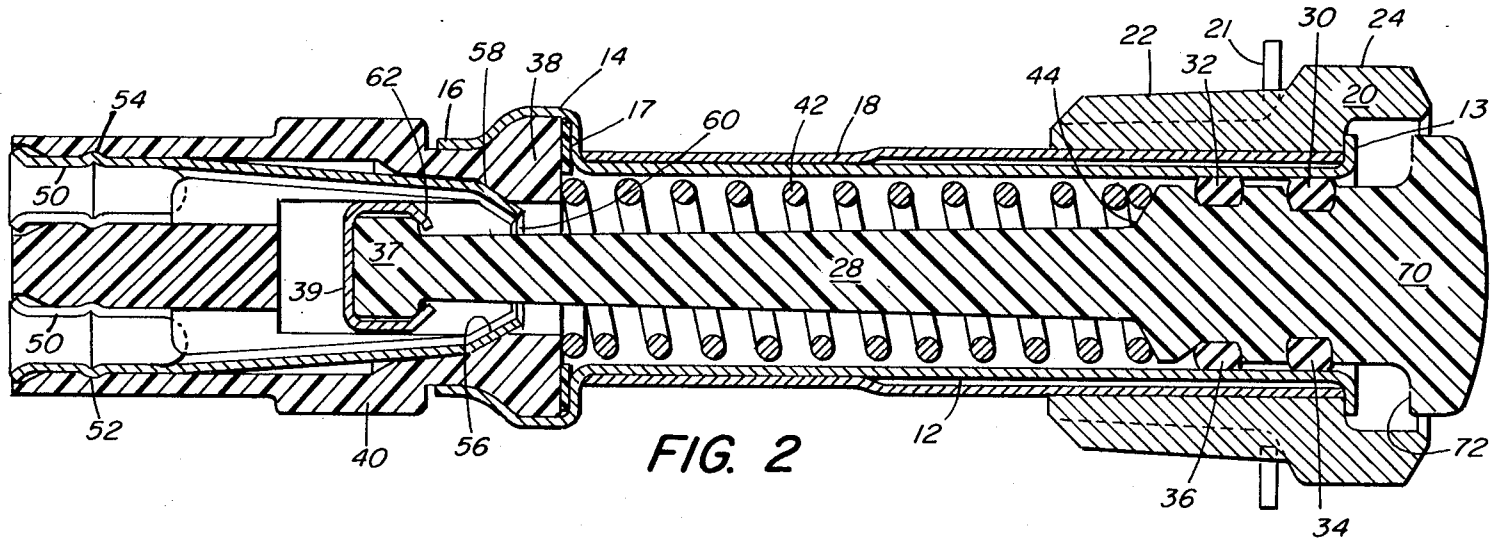

A cap 70 is formed at the right-hand end of the plunger 28 to serve as a physical contact surface with the moving door. FIG. 2 shows the cap, switch and associated elements as they are when the door is closed; FIG. 1 represents the plunger, cap, and associated elements when the door is open. As will be noted in FIG. 2, the contact surface 62 is widely separated from the contact surface 56 when the door is fully closed. Clearly, opening of the switch takes place considerably before the door is fully closed.

Other features of the invention are apparent in the drawing. For one thing, it will be noted that in FIG. 2 the O-ring 34 is within the sleep body 12 when the door is closed but in FIG. 1 it is outside the sleeve 12 when the door is open. Because the O-ring 34 must travel into or out of the sleeve body 12 with each swing of the door, the groove 30 is deeper than the groove 32 to prevent unseating of the O-ring 34. Alternatively, the flange 13 could be tapered to permit easy entry of the O-ring 34. Also, "overslam" protection is provided for in the spacing between the sleeve flange 13 and the matching surface 72 of the cap 70 as is explained immediately below.

The courtesy switch is supplied for installation in a vehicle as shown in FIG. 1. The mounting nut 20 is at the position shown adjacent the base or electrical contact end of the switch. In that position, the nut 20 is freely rotatable about the smaller diameter smooth surface of the sleeve 18 of the mounting assembly. The switch is inserted in an opening in the vehicle door post and the mounting nut 20 is tightened against the post to hold the switch in place. A washer 21 as shown in FIG. 2 may be interposed to protect paint finish.

The switch in FIG. 1 is set at a predetermined maximum gap between door and post with the plunger cap 70 extending well out from the mounting nut. The nut at this time is shown in FIG. 1 at the freely turning position. Closing the door will normally move the plunger against spring pressure, opening the plunger contacts. Should the switch be extending too far out from the door, the door bears on the cap 70 which then bears against the flange 13 which in turn bears against the end of the mounting sleeve 18. The larger diameter surface of that sleeve is forced into the mounting nut 20 where it is frictionally engaged and held. The switch is thus self-adjusted in place in an optimum position.

Because on occasion a door may be slammed with so much force that the door post is deformed, provision is made for a degree of overslam in the switch of the invention. A gap exists between the countersunk surface of the nut where it abuts the flange 13 and the plunger undersurface 72. Should overslam occur, the switch remains operable because of the tolerance which is provided.

It is also noteworthy that the O-ring 36 is at all times within the sleeve body 12 as seen in the full open door position of FIG. 1 and the full closed door position of FIG. 2. Moreover, the cavity of the switch is protected as well by the seal formed by the washer 17 between the switch body 38 and the shoulder 14. Thus, protection against water intrusion caused by rain or melting ice or snow is maintained at all times.

The floating contact 39, by reason of its relatively loose fit over the plunger enlargement 37 and its diagonal forward surface which contacts the matching diagonal surface 56 of the fixed contact, has a wiping action which prevents the build-up of oxides. Also, the circular opening 60 which is formed by the ends of the contact provides self-alignment of contacts by reason of its surrounding of-the smaller end of the plunger 28.

The same design feature of floating contact circular opening and contact body opening in which the enlargement 37 and floating contact 39 are substantially enclosed leads to ease and permanence of assembly of the unit. Also, compactness of size and simplification of installation are enhanced by reason of the total enclosure of essential components in a miniaturized body.

What is claimed is:

1. A self-adjusting switch inserted between a fixed and a movable vehicle component comprising an insulating body having a cavity formed therein, a sleeve assembly joined to said insulating body, a plunger disposed in and relatively freely axially movable in said sleeve assembly, a fixed electrical contact relatively firmly retained in said cavity adjacent one end of said plunger, a movable contact relatively loosely mounted on said one end of said plunger, said contacts being adapted to be opened and closed in response to a predetermined amount of axial movement of said plunger, a cap at the other end of said plunger, and means for mounting said switch in said fixed vehicle component, said sleeve assembly being frictionally engaged and relatively tightly restrained against axial movement in said mounting means, whereby said cap forces said sleeve assembly through said mounting means in response to movement of said movable vehicle component relative to said fixed vehicle component greater than a predetermined amount.

2. A self-adjusting switch as defined in claim 1 including a double seal disposed between said plunger and said sleeve assembly adjacent said other end of said plunger, one seal of said double seal remaining between said plunger and said sleeve assemble irrespective of the position of said plunger relative to said sleeve assembly during axial travel thereof.

3. A self-adjusting switch as defined in claim 1 wherein said insulating body is generally cylindrical, said sleeve assembly is joined peripherally to said insulating body, and a sealing member is interposed between said sleeve assembly and said insulating body portion whereby access to said cavity is blocked.

4. A self-adjusting switch as defined in claim 3 wherein said fixed contact includes at least a portion thereof disposed at an angle to the axis of said insulating body and said movable contact includes at least a portion thereof disposed at a similar angle to the axis of said plunger, axial movement of said plunger in one direction causing said portions to meet with a wiping action.

5. A self-adjusting switch as defined in claim 3 wherein said double seal comprises first and second resilient O-rings, said plunger having first and second circumferential grooves formed therein adjacent said cap to accommodate said O-rings, said first O-ring constituting said one seal remaining between said plunger and said sleeve assembly during all axial travel of said plunger.

6. A self-adjusting switch as defined in claim 5 wherein said second circumferential groove is deeper than said first circumferential groove, whereby movement of said second O-ring in and out of said sleeve assembly with axial travel of said plunger is facilitated.

7. A switch installed in a door post for actuation by movement of a door of a vehicle comprising a mounting nut threaded into said door post, an insulating base having a tapered opening formed therein, a plurality of fixed contacts held in said base and deflected toward each other by said tapered opening to form a contact area, a reciprocal plunger having one end disposed in said base, a floating contact relatively loosely retained on said one end adjacent said contact area, a mounting sleeve assembly fritionally held in relatively tight relationship to said mounting nut, said plunger being reciprocal in said mounting sleeve assembly and having another end extending outwardly therefrom toward said door in a direction opposite said base, and resilient means normally urging said plunger toward said door and maintaining said floating contact in abutting relationship with said plurality of fixed contacts, movement of said door toward said door post causing axial movement of said plunger toward said base and separation of said floating contact from said fixed contacts.

8. A switch as defined in claim 7 and further including first and second seals disposed between said other end of said plunger and said sleeve assembly, said first seal remaining between said plunger and said sleeve assembly ir respective of the position of said door relative to said door post and said second seal remaining between said plunger and said sleeve assembly only when said door is closed against said door post.

* * * * *